United States Patent [19]

Peterson et al.

[11] Patent Number: 4,560,064

[45] Date of Patent: Dec. 24, 1985

[54] CARRIER FOR CANS

[75] Inventors: Bertel R. Peterson, San Juan Capistrano; Vincent E. Fortuna, Huntington Beach, both of Calif.

[73] Assignee: Vercon, Inc., Dallas, Tex.

[21] Appl. No.: 635,998

[22] Filed: Jul. 30, 1984

[51] Int. Cl.[4] ..... B65D 85/30; B65D 75/00

[52] U.S. Cl. ..... 206/159; 206/158; 294/87.2; 294/87.28

[58] Field of Search ..... 206/140, 144, 151, 154, 206/158, 159, 160, 161, 203, 427, 429, 443; 294/87.2, 87.26, 87.28; 217/18

[56] References Cited

U.S. PATENT DOCUMENTS

| | | | |
|---|---|---|---|
| 2,879,100 | 3/1959 | Moore | 294/87.2 |
| 2,894,622 | 7/1959 | Poupitch | 206/159 |
| 3,199,908 | 8/1965 | Poupitch | 206/427 |
| 3,199,909 | 8/1965 | Domenico et al. | 294/87.2 |
| 3,203,581 | 8/1965 | Wherry | 206/159 |
| 3,203,582 | 8/1965 | Waggner, III | 206/159 |
| 3,317,087 | 5/1967 | Landis | 206/427 |
| 3,888,348 | 6/1975 | Frey | 206/427 |
| 3,951,259 | 4/1976 | Oglesbee | 206/427 |
| 4,136,778 | 1/1979 | Mascia et al. | 206/427 |

FOREIGN PATENT DOCUMENTS

| | | | |
|---|---|---|---|
| 642333 | 7/1962 | Italy | 206/427 |

*Primary Examiner*—William T. Dixson, Jr.
*Assistant Examiner*—Brenda J. Ehrhardt
*Attorney, Agent, or Firm*—Roy L. Van Winkle; M. Norwood Cheairs

[57] ABSTRACT

A can carrier suitable for carrying a six-pack of cans including a top plate, bottom plate and spacer holding the top plate and bottom plate in relative position. Each part can be constructed from a sheet of plastic. The top plate and bottom plate each include arcuate recesses defining arcs of greater than 180° to contain the cans. The recesses in the top plate are such that the can body is closely received therein and the can is prevented from dropping from the carrier by the engagement of the top flange on the can with the top plate of the carrier.

6 Claims, 4 Drawing Figures

CARRIER FOR CANS

BACKGROUND OF THE INVENTION

This invention relates generally to carriers for a plurality of cans and the like. More particularly, but not by way of limitation, this invention relates to a carrier constructed from plastic that facilitates the carrying of a six-pack of cans or the like.

Initially, cans were transported by simply placing them in cardboard boxes. Since the cans were generally manufactured from metal, they were not breakable and thus did not even require separators in the boxes between the cans. More recently, it has become a fairly common practice to sell cans containing such items as soft drinks, soups, juices and the like in six-pack containers. It has also become fairly common practice to package the cans in the six-pack containers within boxes for transportation. This requirement defines the space limitations for of six-pack carriers. That is, the carrier must fit within the confines of the six cans so that excess carton space is not required.

For the most part, such six-pack carriers have been constructed from heavy grade paper and as such have been destroyed upon removing the cans from the carrier or in the event that the carrier should come in contact with a substantial amount of water. More recently, some carriers have been constructed from a plastic sheet through which the cans were inserted. Ordinarily, such carriers are destroyed upon use.

More elaborate carriers have been constructed, but they are so expensive that their use is generally limited to specialized and generally rather high-priced items. The aforementioned carriers have all worked generally satisfactorily.

An object of this invention is to provide an improved carrier for a plurality of cans that is constructed from plastic, and can be manufactured rather inexpensively, that is sturdy and reusable and one that fits within the defined space limitations.

SUMMARY OF THE INVENTION

This invention then provides an improved carrier for cans. The cans include a cylindrical can body, a top and a bottom attached to the ends of the can body. The top of the can is encircled by a flange forcing that projects radially outwardly beyond the can body. The improved carrier comprises a bottom plate member that includes arcuate recesses sized to receive the can body. Each of the recesses includes an arc greater than 180°, forming a pair of resilient can engaging fingers in the bottom plate for retaining a can body therein. A top plate member also includes arcuate recesses that are sized to receive the can body and that are engageable with the flange portion. These recesses also include an arc of greater than 180° forming a pair of resilient can engaging fingers in the top plate member for retaining the can body therein. A spacer member is attached to and extends between the bottom and top plate members for holding the recesses in the plate members in alignment and appropriately spaced to receive the cans.

BRIEF DESCRIPTION OF THE DRAWING

The foregoing and additional objects and advantages of the invention will becomes more apparent as the following detailed description is read in conjunction with the accompanying drawing wherein like reference characters denote like parts in all views and wherein.

DETAILED DESCRIPTION OF THE PREFERRED EMBODIMENT

Figure 1:
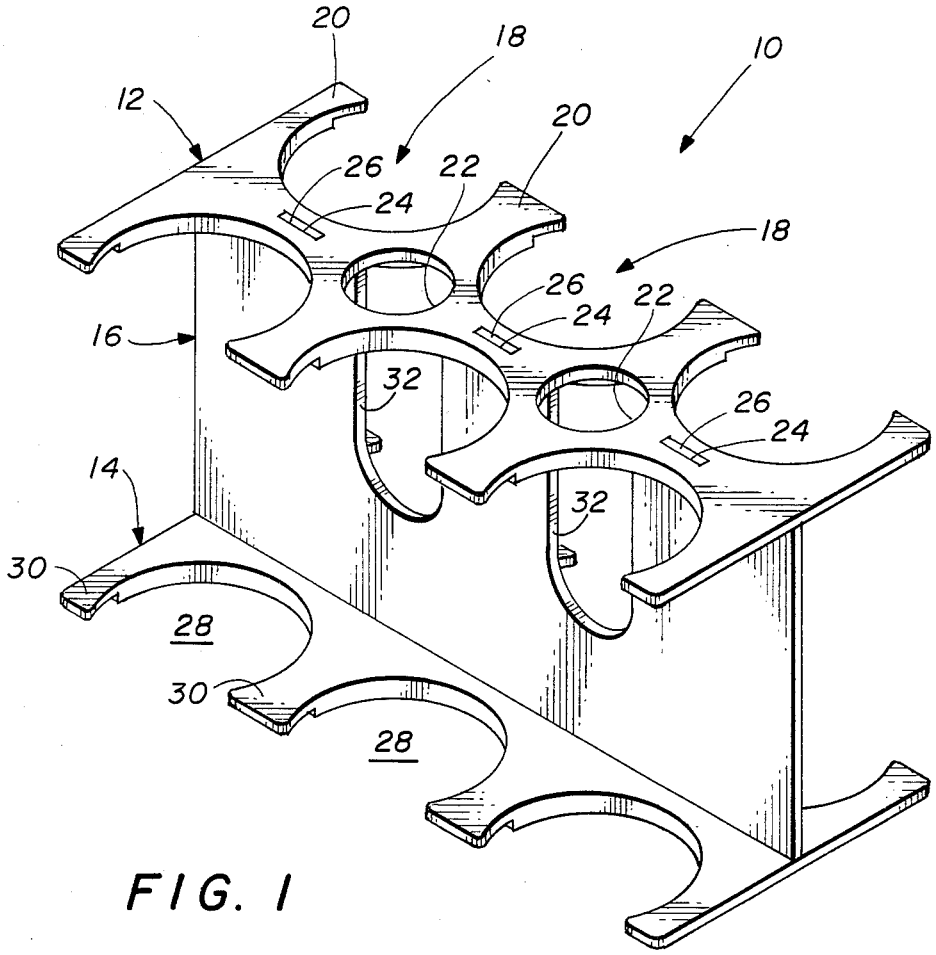
FIG. 1 is a perspective view of a carrier that is constructed in accordance with the invention.

Referring to the drawing, and to FIG. 1 in particular, shown therein and generally designated by the reference character 10, is a can carrier that is constructed in accordance with the invention. The can carrier 10 includes a top plate 12 and a bottom plate 14 that are held in spaced relationship by a spacer 16. The top plate 12 includes a plurality of arcuate recesses 18, each recess 18 forming a pair of resilient can engaging fingers 20. The top plate 12 is also provided with a pair of spaced holes 22 for purposes that will be more fully explained hereinafter. It will also be noted that the top plate 12 includes a plurality of holes 24 that are spaced along the top plate 12 for receiving locking tabs 26 formed on the spacer 16. The holes 24 and tabs 26 will be discussed more fully in connection with the description of FIG. 4.

The bottom plate 14 includes a plurality of similarly formed arcuate recesses 28 that also form can engaging fingers 30. The arcuate recesses 28 include an arc of greater than 180°. Although not illustrated, the spacer 16 is attached to the bottom plate 14 in a manner similar to the attachment between the spacer 16 and the top plate 12.

In addition to the tabs 26, the spacer 16 is provided with recesses 32 that are aligned with the holes 22 formed in the top plate 12. The holes 22 and the recesses 32 cooperate to permit a person carrying the carrier 10 to insert his thumb and fingers therein to facilitate handling of the carrier.

Figure 2:
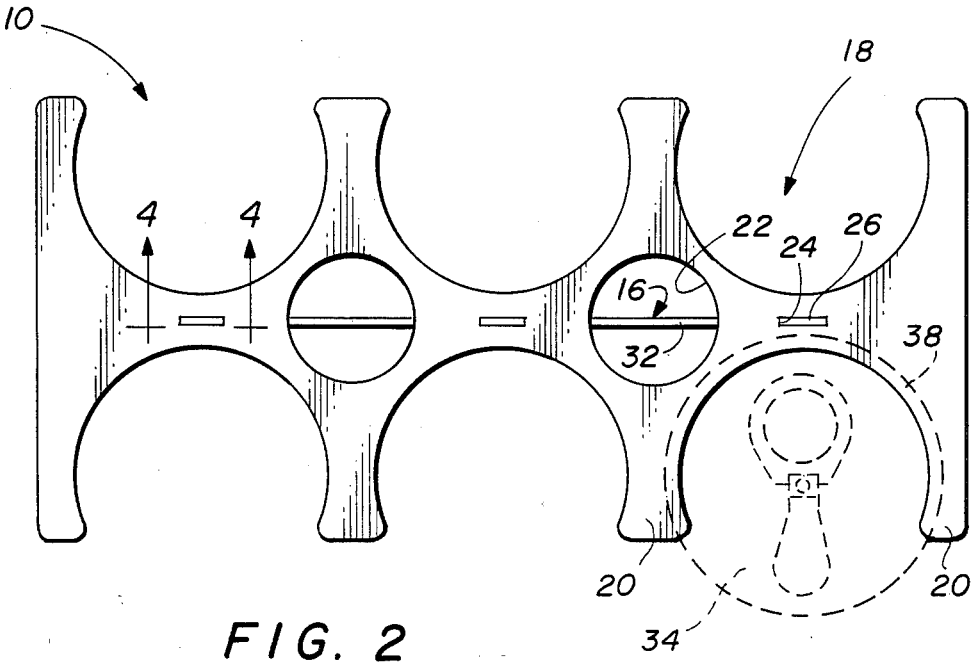
FIG. 2 is a top plan view of the carrier of FIG. 1.
Figure 3:
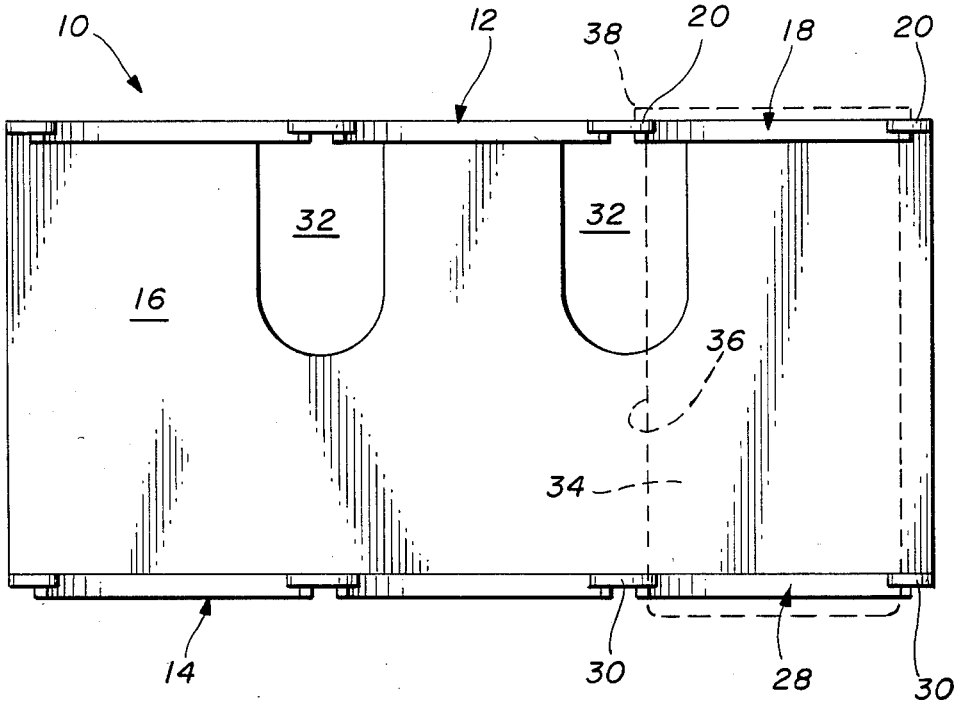
FIG. 3 is a side elevation view of the carrier of FIG. 1.

FIGS. 2 and 3 both illustrate, in dashed lines, a can 34 that is located in the aligned recesses 18 and 28. The diameter of the can body 36 fits snugly into the recesses 18 and 28 while a top flange on the can 34 is of greater diameter than the recesses and overlays the fingers 20 as illustrated in FIGS. 2 and 3. Thus, the can 34 is prevented from falling outwardly of the recesses 18 and 28 by the fingers 20 and 30, and is prevented from dropping through the bottom of the carrier 10 by the engagement of the flange 38 on the can 34 with the fingers 20 on the top plate 12.

Figure 4:
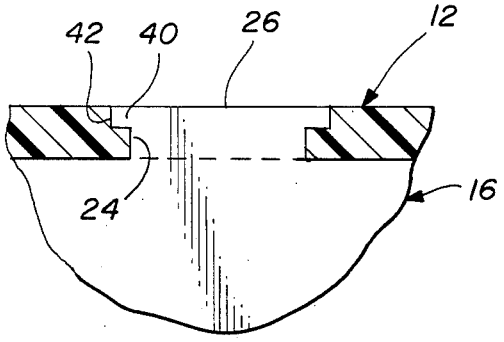
FIG. 4 is a fragmentary view, partly in cross section, illustrating one method of attachment of the spacer member to the top and bottom plate members.

Referring to FIG. 4, the enlarged fragmentary cross section view shown therein illustrates one method of attaching the spacer 16 to the top plate 12. As illustrated, the tab 26 includes an enlarged portion 40 that fits within a recess 42 in the top plate 12. The arrangement is such that the enlarged portion 40 on the tabs 26 lock the spacer 16 into the top plate 12 and into the bottom plate 14. Manifestly, the spacer 16 can be glued to the top plate 12 and the bottom plate 14 if desired. In either event, the structural arrangement is such that the top plate 12, spacer 16 and bottom plate 14 can be easily made from a sheet of plastic material.

The cans 34, when filled with liquid or food, are relatively heavy and thus the carrier 10 must have sufficient rigidity to support the weight of the filled cans. However, it will be realized that the material utilized in forming the carrier 10 must also be sufficiently resilient to permit the cans to be inserted and removed easily from the recesses 18 and 28. It has been found that high impact styrene meets the necessary criteria of rigidity and resiliency.

From the foregoing, it will be appreciated that the can carrier described can be quickly and easily constructed from a simple sheet of plastic, that it fits within the dimensions required in packaging, and that the container is both sturdy when assembled and durable enough to be reusable.

It should also be apparent from the foregoing detailed description of the single embodiment of the invention that many changes and modifications that can be made thereto without departing from the spirit and scope of the annexed claims.

What is claimed is:

1. An improved carrier for a can that includes a cylindrical can body having an exterior, a top and a bottom attached to the ends of said can body, said top including a flange portion projecting radially outwardly beyond the exterior of said can body, said carrier comprising:

a bottom plate member including arcuate recesses sized to receive the exterior of said can body, each said recess including an arc of greater than 180° forming a pair of resilient can engaging fingers in said bottom plate member for retaining said can body therein by partially encircling the exterior of said can body;

a top plate member including arcuate recesses sized to receive the exterior of said can body and engageable with said flange portion for supporting said can, said recesses including an arc of greater than 180° forming a pair of resilient can engaging fingers in said top plate member for retaining said can body therein by partially encircling said can body below said flange portion; and, a spacer member is attached to and extends between said top and bottom plate members for holding the recesses in said plate members in alignment.

2. The carrier of claim 1 wherein:

said top plate member also includes a pair of spaced holes; and, said spacer member also includes spaced recesses adjacent to said top plate member aligned with said spaced holes to facilitate carrying of said carrier and cans.

3. The carrier of claim 2 wherein said members are formed from a plastic.

4. The carrier of claim 3 wherein said plastic is high-impact styrene.

5. The carrier of claim 3 and also including an adhesive for connecting said members.

6. The carrier of claim 3 wherein:

said spacer member includes top and bottom edges and has a plurality of spaced tabs projecting from said edges; and, said top and bottom members each have a plurality of tab receiving holes therein for receiving and engaging said tabs to retain said carrier assembled.

* * * * *